United States Patent [19]

Rosa

[11] Patent Number: 4,546,983

[45] **Date of Patent: * Oct. 15, 1985**

[54] MULTI-SPECTRAL TARGET

[75] Inventor: Stephen P. Rosa, Bethesda, Md.

[73] Assignee: TVI Energy Corporation, Beltsville, Md.

[ * ] Notice: The portion of the term of this patent subsequent to Dec. 27, 2000 has been disclaimed.

[21] Appl. No.: 555,800

[22] Filed: Nov. 28, 1983

Related U.S. Application Data

[63] Continuation-in-part of Ser. No. 302,878, Sep. 18, 1981, Pat. No. 4,422,646.

[51] Int. Cl.[4] ..... F41J 9/13

[52] U.S. Cl. ..... 273/348.1; 250/495.1; 343/18 C

[58] Field of Search ..... 273/348.1, 360; 219/345, 354, 548, 549; 250/495.1, 504 R; 343/18 C

[56] References Cited

U.S. PATENT DOCUMENTS 3,690,662 9/1972 Pasqualini ..... 273/360
4,240,212 12/1980 Marshall et al. ..... 273/148.1

FOREIGN PATENT DOCUMENTS 592343 2/1960 Canada ..... 343/18 C

*Primary Examiner*—Anton O. Oechsle
*Attorney, Agent, or Firm*—Beveridge, DeGrandi & Weilacher

[57] ABSTRACT

An infrared target made up of a plurality of infrared radiating modules simulates a military asset. The modules have radiating portions that generate infrared signals matching the thermal cues making up the thermal signature of the asset. The modules are designed using as variables the size, shape, area, thickness and composition of a radiating portion so the infrared signal is of the desired shape and intensity. Visible graphics cover the modules to depict the asset in visible light. A radar corner reflector simulates the asset to radar apparatus.

13 Claims, 12 Drawing Figures

FIG. 6
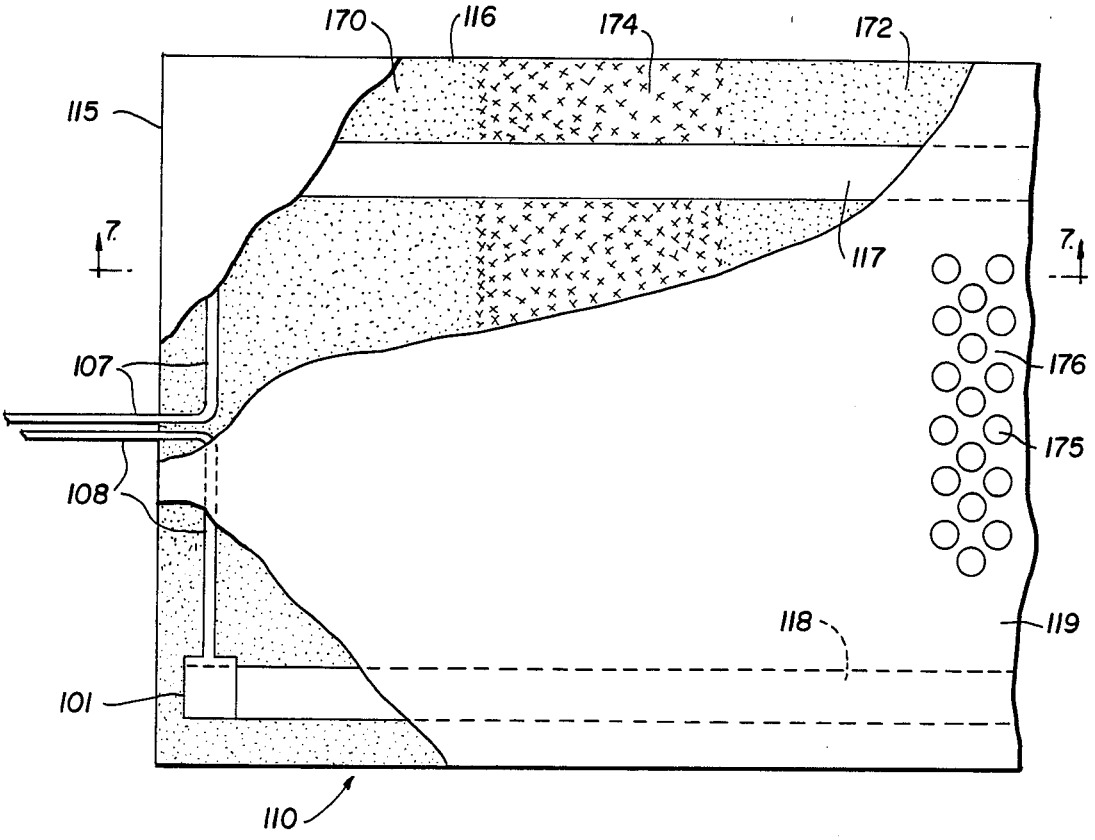
FIG. 7
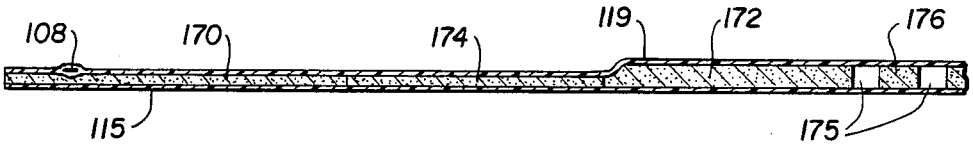
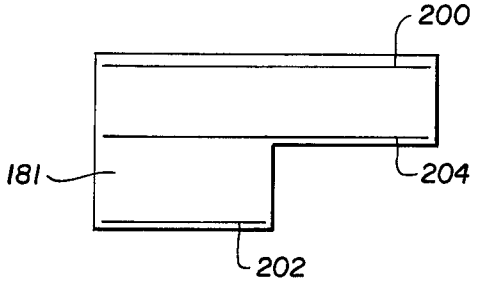
FIG. 12

MULTI-SPECTRAL TARGET

This application is a continuation-in-part of my copending application Ser. No. 302,878, filed Sept. 18, 1981, now U.S. Pat. No. 4,422,646, issued Dec. 27, 1983.

BACKGROUND OF THE INVENTION

This invention relates to an electrically operated military target capable of emitting an infrared signal when an electrical current is passed therethrough. The target also presents a visual image when exposed to visible light, said visual image being detectable and identifiable with the unaided eye, or when using a wide range of optical lenses and electro-optical viewing systems including image intensification equipment.

With the advent of thermal sights for conducting military operations such as surveillance, reconnaissance, target detection and tracking, and weapon system guidance, there arose a need for targets suitable for conducting training in these military skills. Infrared detection and sighting equipment is now available in a large number of configurations, levels of capability and technical sophistication and is deployed on a wide variety of military platforms. These include strike and reconnaissance aircraft, helicopters, ships of various types, and many armored fighting vehicles—(AFV's)—such as main battle tanks (MBT's), armored personnel carriers (APC's) and numerous other general and special purpose vehicles. Infrared detection devices have even been made small enough to be man-portable.

The use of infrared detection and sighting equipment for military applications is expanding due to the potential such equipment possesses to improve the combat effectiveness of military forces, especially at night, in adverse weather, and in some conditions of obscured visibility, such as when a battlefield is visually obscured by smoke from fires, smoke canisters or generators, or other pyrotechnics. Acquisition of the ability to conduct operations at night, however, through the use of infrared detection and sighting equipment is a particularly significant factor motivating many of the world's armed forces to develop and deploy such equipment in large numbers, and to constantly upgrade existing systems. Such equipment has already been proven effective in combat.

The effectiveness of infrared detection and sighting equipment is due to the fact that all objects possessing a surface temperature greater than absolute zero dissipate energy in accordance with the laws of thermodynamics. One principal way in which that energy is dissipated is through the process of radiation, where the energy is emitted in the form of an electromagnetic transmission having wave lengths and amplitudes determined by the object's surface temperature. This dissipated heat energy traveling through air or space is known as infrared radiation, and infrared detection and sighting devices can sense these transmissions. The equations, physical laws and constants necessary to calculate the specific characteristics of such infrared, or IR, radiation and the reference sources that can be useful to assist such work are well-known.

IR detection and sighting equipment, by sensing the IR radiation emitted by an object, can thus be said to be able to 'see' that object by the heat it gives off as radiation. This detectable radiated heat energy, also known as thermal energy, is called the object's thermal signature, and an IR detection and/or sighting device that can 'see' an object's thermal signature is also known as a thermal imager.

The ability to detect a military asset such as an enemy tank, plane or ship by the target's thermal signature is of military importance. Moreover, if the thermal signature is sufficiently strong and clear, it can be used to identify the target by its type and reveal certain information about its operating condition, such as whether it is moving, sitting with the engine idling, or a number of other things. Such thermal imaging techniques are well-known in the art.

In order to exploit the potential of these thermal imaging systems, the crews of planes, helicopters and AFV's equipped with such systems must be trained to be proficient in their use. This is true because the thermal signature of a military asset such as an enemy tank bears some, but not a total, resemblance to that asset's visual signature. Since it is the visual signature of the asset that such crew members have previously learned to see with their eyes, they must be taught to recognize the thermal signature of the same asset. This is not a simple recognition process to learn: the thermal signature of an asset not only differs from the visual signature, but can itself also vary, depending upon the operating condition of the asset and the state of its environment.

The required level of proficiency can only be achieved through detailed training, and a useful element in any thermal imager training program is a thermal target. A suitable target would be able to simulate the thermal signature of a military asset such as a tank or other vehicle. While a real vehicle would be the ideal target for such training, these are usually very expensive to use for weapon system live fire training, and in the case of most modern enemy equipment, typically not available at all.

It is desirable that the IR radiation emitted by the target simulate the radiation characteristically emitted by the real military asset as to both intensity and pattern. Each type of asset such as enemy equipment emits thermal energy in a manner dependent upon a number of factors. These factors include the type of equipment, whether it is operating or not, and the weather conditions prevalent at the time of observation. This characteristic thermal signature is composed of a number of key elements, known as thermal signature cues. The cues can be used by personnel proficient in the use of thermal imaging equipment not only to detect a target, but also to identify it by nationality and type of equipment, to determine whether the target is moving, and if so, in which direction, to determine if it is firing or has recently fired its weapons, and to ascertain many other items of militarily valuable information.

For example, a tank moving on a road will have its tracks quickly heated through friction with the road surface, and the tracks will heat the road wheels, drive wheels and idler wheel through conduction. These hot tracks and wheels emit IR radiation which is detectable by a thermal imager, and so the hot tracks and wheels form part of the tank's thermal signature. Because the tracks form large, intense and easily identifiable portions of that signature, and because the wheels provide round, easily identifiable elements in the same signature, the tracks and wheels of an enemy vehicle are important thermal signature cues. Under proper viewing conditions, proficient personnel can count wheels, gauge their diameter and spacing relative to the rest of the thermal signature, and use this information to identify the vehicle by type and nationality. If all the wheels are clearly identifiable, but the tracks are not, these facts can be used to determine that the vehicle is a tank viewed from a flank aspect. These are just some of the ways that the cues of a thermal signature can be interpreted to yield valuable information. Clearly, other types of equipment will have their own distinctive cues enabling them to be identified with a thermal imager.

A target that simulates the thermal cues of an enemy vehicle's thermal signature can be used for a number of training purposes, including:

1. Detection Training: where AFV crews would be taught to discriminate the thermal signature of an object from its background and assign this detected thermal signature to a class of potentially interesting (or threatening) objects.
2. Classification Training: where the AFV crews would learn to assign the detected thermal signature to a gross class of objects (such as vehicles, or helicopters on the ground, etc.)
3. Recognition Training: where the AFV crew learns to assign the classified object to a specific subclass such as tanks, or trucks.
4. Identification Training: where the AFV crew learns to assign the recognized thermal signature to an even more specific category such as M-60 tanks, or 2.5 ton trucks.

Those expert in the field of training and target analysis will recognize that the degree of difficulty in accomplishing these tasks increases from detection to identification. A single target that is sufficiently accurate to permit any level of the above training would have real value, as it would allow AFV crews to learn as much as they could without having to change training devices.

These same values accrue if the target possesses an accurate visual signature of the enemy vehicle as well. Thus with one target, thermal and visual detection, classification, recognition, and identification training can be accomplished simultaneously. As an AFV crew would use thermal and visual sighting systems simultaneously in combat if possible, this permits the crew to exercise their equipment in training as they would use it in battle.

If the target not only has the thermal signature of a vehicle, but also the visual signature superimposed upon the thermal signature, it is known as a multi-spectral target. Being on the target face, the visual signature is unobscured, and the thermal signature can be radiated through the visual signature. From dawn to dusk, and in night situations where image intensification and electro-optical devices can be used, an enemy's visual signature can be used for detection purposes. Friendly personnel must be proficient in recognizing both the enemy's thermal and visual signatures, and thus a multi-spectral target is of great value.

Such a multi-spectral target can also be upgraded to provide a radar signature as well. This can be accomplished in a number of ways including the use of aluminum or other metallic foils bonded or otherwise attached to the target and formed as necessary to simulate the corners, crevices, joints and voids characteristic of the military asset being simulated. A preferred embodiment uses corner reflectors suitably sized and positioned and other metallic or conductive meshes and materials incorporated into the target, interconnected in a low impedance circuit, as necessary. Those familiar with milimeter wave and radar signature generation and detection will easily recognize the number of ways in which an acceptable radar signature can be simulated.

Multi-spectral targets that simulate the signatures of our own vehicles or those of our allies are also useful. Our personnel must be proficient in recognizing when not to shoot at a detected vehicle because it is a so-called 'friendly' vehicle. This proficiency can be gained through 'friend or foe' target recognition and identification training in which targets simulating both friendly and enemy vehicles are presented. Such training reduces the chance of fratricide during a confused combat situation.

Additionally, multi-spectral targets that effectively simulate our own vehicles can be used as decoys against an enemy in a battle. Since the targets accurately represent the detectable signatures of our vehicles and equipment, they are effective in a deception operation intended to confuse the enemy about the numbers, types and locations of our deployed forces. They draw his fire away from our real equipment and divert his attention so that ambushes and other military maneuvers can be executed effectively.

The most useful embodiment of such a multi-spectral target is one which is easily carried into the field by the troops who will use it for training or other purposes. Such a target configuration should be very lightweight, so it is man-portable; of few parts, so it is easy and quick to set up and start operating; and reliable, so training or other missions can be executed faithfully and with confidence. The preferred multi-spectral target has its own support structure so that it can be set up anywhere, quickly, in response to any training or other military requirement. It should also be relatively inexpensive in order that it can be used for live fire training if necessary, or set up and expended as part of a military deception operation.

Accordingly, there is a need in the art for a low cost expendable target for use in live fire or many other types of training and military purposes, which will emit thermal radiation that closely matches the thermal signatures of enemy or friendly assets as they appear in the field, and will reflect visible light in a manner so as to simulate the corresponding visual signature of that asset. Such a target should be self-contained, easy to transport, set up and use in the field, reliable, and durable enough to support a variety of military operations. Advantageously, it can be upgraded to include the corresponding radar frequency signature of that asset. Ideally, it should be repairable to promote its long term useful life.

SUMMARY OF THE INVENTION

This invention provides a low cost thermal target suitable for use with thermal sights. More particularly, this invention provides an electrically operated military target which includes modules capable of emitting an infrared signal when an electric current is passed therethrough from an electrical power source having two poles. Each module corresponds to one or more thermal cues of a military asset and is a unitary, composite, flexible laminate.

The laminate has electrically insulating top and bottom layers, each layer having an inner surface and an outer surface. A substantially continuous electrically conductive layer is provided between the inner surfaces of the top and bottom layers. At least two substantially parallel, flexible, electrical conductor means, such as metallic wires or busbars, are provided in contact with the electrically conductive layer. A first electrical connector connects each end of one of the conductors to one pole of the electrical power source. A second electrical connector connects each end of another of the conductors to the other pole of the electrical power source.

The top layer and the bottom layer have edges which are sealed together to form an enclosed laminate containing the electrically conductive layer and electrical conductor means. A flexible, thermally insulating pad containing a multiplicity of air-containing cells may be provided over the outer surface of the top layer to minimize convective and conductive heat losses.

The present invention allows the signature emitted by the target to be accurately matched to the known signature of actual military assets. The modules making up a target can be modified in a number of ways to emit cues having desired characteristics. The intensity of the cue emitted by a module can be attenuated by forming perforations in the module to decrease the surface area emitting radiation. The infrared signal intensity can be increased by increasing the thickness of the conductive layer, thereby increasing the current through the module. Modules can be separately energized to vary the current through them and thereby vary the intensity of the cues they emit. Further, cue matching can be achieved by forming the modules in various sizes and shapes as needed for signature completion.

The present invention includes a target that can be set up curved, so that it presents a signature to viewers at different angles. Any suitable support may be used in setting up a curved target. The preferred support frames are lightweight portable stands manufactured by either Nomadic Structures, Inc., 205 South Columbus Street, Alexandria, Va. 22314 or MF Graphics, 12700 S.E. Crain Highway, Brandywine, Md. 20613. In a preferred embodiment, a substrate is supported on the support frame. It has a visible light responsive representation of a military asset on the front thereof exposed to the trainee's line of sight to provide visible light cues. The modules are, in turn, supported on the rear of the substrate. In addition, radar reflectors may be mounted on the target to simulate an asset's radar image. The visual signature can be applied to the flexible substrate in a number of ways including silk screening, hand painting, stenciling, and a number of photographic processes. The use of photographic panels, while possible, is not recommended because the ultraviolet rays from the sun will quickly destroy the visual image. Any paint application should recognize that the constant flexing and rolling/unrolling of the flexible substrate will cause some paint candidates to flake and chip off. This must be avoided as the visual image of the target can be seriously degraded.

The preferred method for applying the visual image to the flexible substrate is by taking a suitable photograph of the front and/or sides and/or top view of the asset to be simulated, and using a special computer controlled process, scale the photograph up to the desired size and paint the photographed image in full color on an outdoor canvas layer. Canvas is one material suitable for the application, as it takes the paint well and is reasonably durable. It is also heavier and can shrink in the weather as compared to other potential candidate substrates such as rip stop polyester or nylon.

Such a computer image generation process is the 3-M Company's ScanaMural product, available from the 3-M Company, 3-M Center, St. Paul, Minn. While somewhat more expensive than other possible visual image generation methods, this method produces visual images of high fidelity and through the accurate replication of shadowing, as captured in the original photograph, presents a target with apparent 3-dimensional characteristics.

BRIEF DESCRIPTION OF THE DRAWINGS

This invention will be more fully understood by reference to the drawings in which:

FIG. 6 is an elevation of another embodiment of a module incorporating features according to the invention, partially broken away;

FIG. 7 is a sectional view of the module of FIG. 6, taken along line 7—7, looking in the direction of the arrows, and on a larger scale;

FIG. 12 is a diagram illustrating the placement of the busbars in module 195 shown in FIGS. 10 and 11.

DETAILED DESCRIPTION

Figure 1:
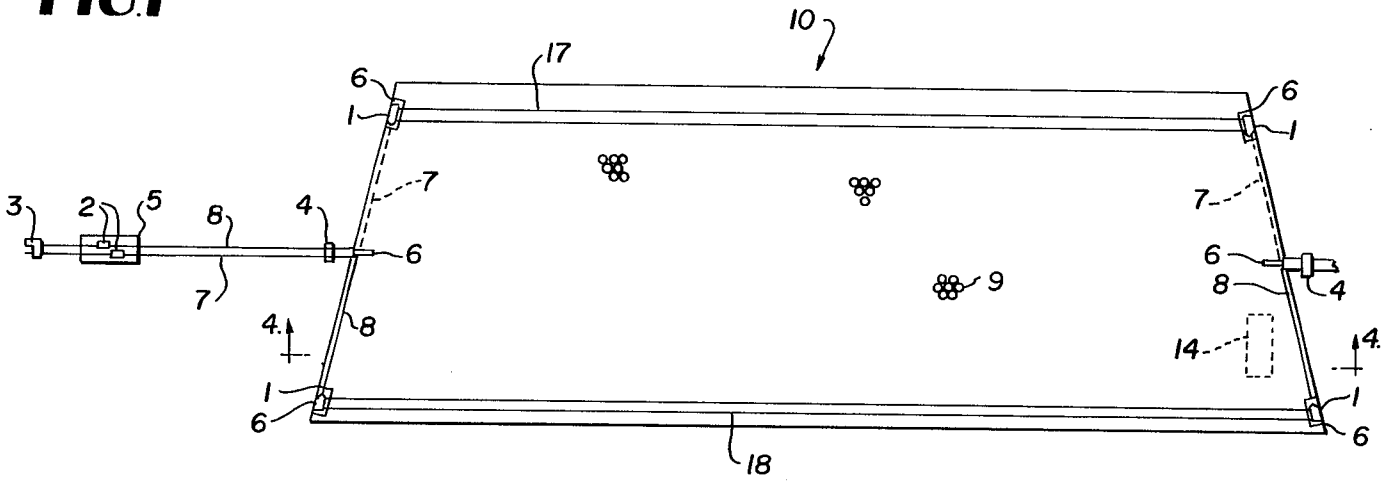
FIG. 1 is an elevation view of a module of the invention corresponding to the thermal cue of the turret section of a military tank.
Figure 2:
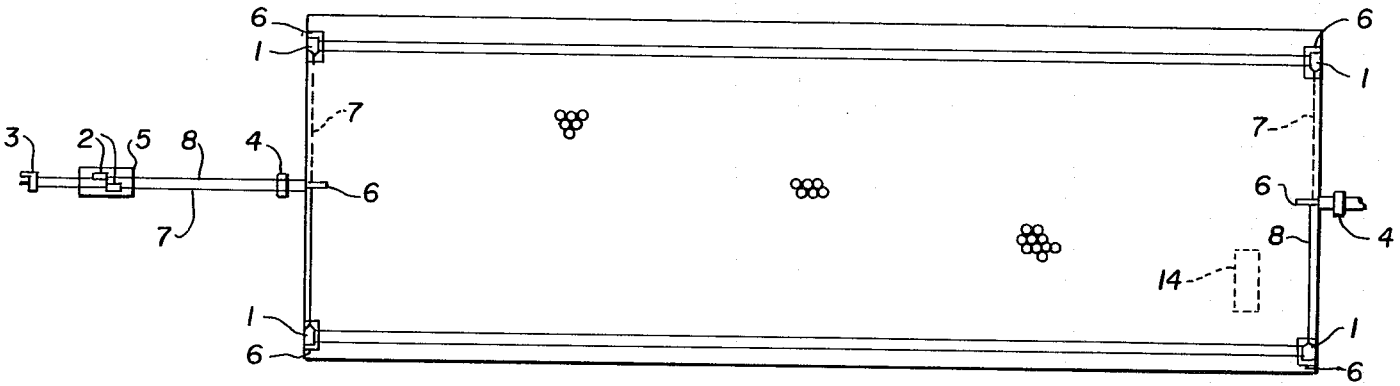
FIG. 2 is an elevation of a module of the invention corresponding to the thermal cue of the hull section of the tank.
Figure 3:
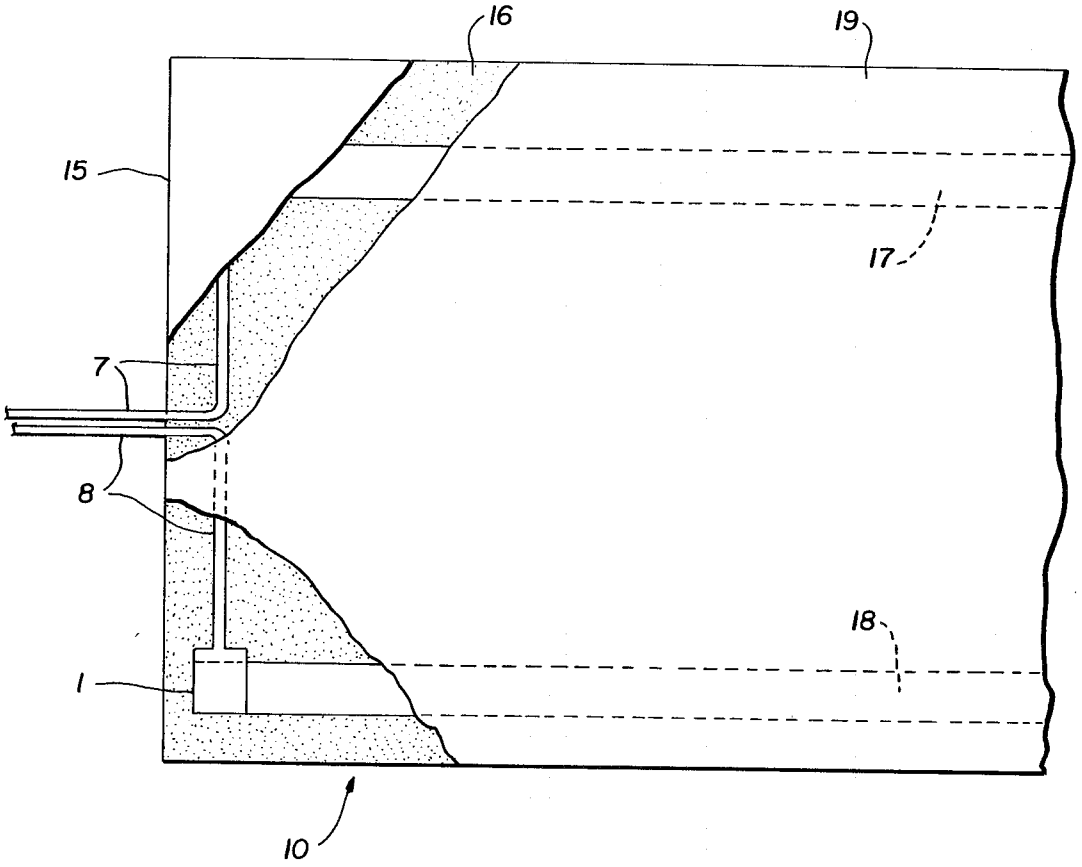
FIG. 3 is an elevation of a portion of the module shown in FIG. 2, partially broken away.

Referring to FIG. 1, there is depicted a module of the invention corresponding to the thermal cue of the turret section of a military tank vehicle. The module comprises a unitary, composite, flexible laminate generally shown as 10 in the Figures. FIG. 2 is an elevation of a module corresponding to the hull section of a tank, and FIG. 3 is an enlarged elevation of the module of FIG. 2 with various layers progressively broken away from right to left to show its elements. The modules of FIGS. 1 and 2 are substantially identical in construction; they vary only in shape.

In FIG. 3, an electrically insulating bottom layer 15, preferably a polyester film, and particularly preferably a polyethylene terephthalate, such as a flexible Mylar film, has thereon an electrically conductive layer 16 of substantially uniform thickness. The insulating layer provides weather-proofing as well as electrical insulation. The electrically conductive layer 16 is comprised mainly of carbon. Typically, the layer 16 will be a substantially continuous carbon-containing material dispersed in a suitable cured binder system. The layer can also be comprised of a fabric or a web impregnated with carbon, such as a carbon-impregnated asbestos sheet. The conductive layer may be quite thin, in the range of under about 0.01 inch, and lightweight in the range of about 1 to about 3 ounces per module.

Substantially parallel, flexible, metallic conductors, such as wires or busbars 17 and 18, are provided in contact with the electrically conductive layer. The wires or busbars can be provided with an electrically conductive adhesive layer to bond them to the electrically conductive layer 16 or electrically insulating top layer 19, which is also typically a flexible Mylar sheet. Preferably, electrical conductor means 17 and 18 are copper foil strips.

In order to connect the conductors 17 and 18 to an external power supply, they are provided with external electrical connectors 3, shown in FIGS. 1 and 2. Connection is made by crimping, soldering, brazing or otherwise securing electrical connectors 1, such as metallic foil connectors, to stranded, metallic wires 7 and 8. A preferred connector is the Termifoil crimp type clip, manufactured by AMP, Incorporated of Harrisburg, Penna. Electrical connections of the type described are made at each end of the module of the target. Thus, both ends of busbar 17 are connected to wires 7. Both wires 7 are to be connected to a single pole of an electrical power source having two poles. As will be apparent, the system will work with an electrical power source having more than two poles, such as a Wye or Delta a.c. source, should such be available. Both ends of busbar 18 are similarly connected to wire 8 for connection to another pole of the electrical power source.

A top layer 19 is sealed to the bottom layer 15, such as by means of an adhesive Mylar tape, to form an enclosed laminate containing the electrically conductive layer 16 and conductor means 17 and 18.

Figure 4:
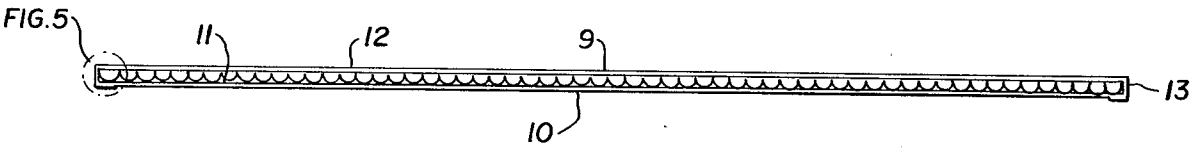
FIG. 4 is a sectional view of the module of FIG. 1, taken along line 4—4 and looking in the direction of the arrows.
Figure 5:
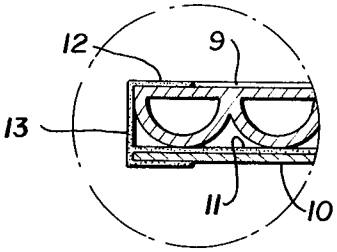
FIG. 5 is an enlarged view of the circled portion of FIG. 4.

Referring to FIGS. 4 and 5, the laminate 10 may have in contact with its outer surface a flexible, thermal insulating pad 9 containing a multiplicity of discrete, air-containing cells. This can be readily accomplished by providing an adhesive layer 11 between the thermal insulating pad 9 and the laminate 10. In order to ensure a moisture-proof seal between the thermal insulating pad 9 and the laminate 10, the edges can be taped, such as with a sealing tape 13. Sealing tape 13 can typically be an adhesive Mylar tape. The use of a pad 9 is optional, depending on the thermal signature sought to be transmitted and the effect such a pad will have in inhibiting transmission. The exposed surface of the thermal insulating pad can then be provided with a suitable decorative or functional coating 12, such as an olive-drab paint, if desired.

In order to strengthen the area around the electrical connections and the laminate, Mylar tape 6 can be provided in the area covering each electrical junction 1 or splice. In addition, in order to provide proper polarity and avoid error during assembly and use, the wires connecting the electrical conductor means 17 and 18 to an external power supply can be color coded. For example, red insulated stranded wires 7 connect one busbar with one pole of the electrical power source, and black insulated stranded wires 8 connect the other busbar with the other pole. Similar color coding of wires can be used outside the module, as shown in FIG. 2. The wires outside the module can then be provided with an electrical connector 3 through insulated butt splices 2, which are covered by a heat shrinkable tubing 5 to protect the electrical connection from environmental and mechanical damage. Vinyl electrical tape 4 can be employed for added strength and protection. When complete, the module can be provided with a suitable identifying label 14.

As mentioned above, the difference between the modules of FIGS. 1 and 2 is in their shapes. It will be understood that a module can have any configuration such that its shape will correspond to a thermal cue or thermal image of a military asset, such as a military vehicle or weapon. The various modules which together make up a target need not have the same size or shape. The laminate may be cut, shaped or modified to achieve additional desired effects. In addition to the two modules shown in FIGS. 1 and 2, additional modules can be provided; for example, modules corresponding to the image projected by the front of a vehicle can be added. By the addition of suitable modules, three-dimensional objects emitting infrared signals can be provided. This is particularly advantageous when the targets are used for training from aircraft.

In operation, each of the modules, if more than one is needed, is connected to an electrical power source. They may be individually connected to separate power sources, or interconnected among themselves in series or parallel, as desired. The power source can be any suitable source, a.c. or d.c., capable of providing a suitable voltage and power to the modules. An electrical current passes through the connecting wires 7 and 8 to busbars 17 and 18 and then through the electrically conductive layer 16. This results in each module emitting an infrared signal from its entire surface. A detectable thermal signature cue operates in the range of 5 to 10 watts per square foot or higher. The shape and size of the module can be tailored to represent any portion of a military asset, and even only a small portion of the object corresponding to the aim point of the sight.

In a training situation the modules are deployed on supports on a gunnery range so that the infrared signal emitted by the target can be detected by the trainee. The thermal insulating pad 9 may permit the passage of the infrared signal while retaining heat in the panel. This prevents excess heat loss from degrading the quality of the infrared signal. Thermal insulating pad 9 minimizes convective and conductive heat loss and maintains the module at a relatively constant temperature during operation.

In live fire training, a weapon is aimed toward the target and typically toward the center of a module. Thus, when the target of this invention is fired upon, a projectile may penetrate and perforate one of the target's modules. However, penetration of the module does not disable it, because the conductive coating between the busbars provides an infinite number of parallel conductive paths for the electric current. If the busbars 17 and 18 are intact, electric current can still pass through the remaining portions of the electrically conductive layer 16. If one of the busbars is severed, current is still provided to the layer 16 from the remainder of the busbar, connected at its ends to the power source. Moreover, if one of the connections between a busbar and its lead 7 or 8 is severed, electrical power is still provided to the module by the undamaged connection at the other end of the module. Thus, the target can be subjected to repeated hits over an extended period of time without destroying its usefulness. Modules in the center of the target should especially be provided with such redundant connections, since they are the most likely to be perforated by a projectile.

Because of the uniformity provided in the targets of this invention, thermal and visual signals are identical from target to target. Thus, different training crews see identical targets. Firing results can be accurately graded and compared between tactical units. Furthermore, the emitted infrared signals can be duplicated from day to day with the only variable being environmental conditions.

Because of the modular design, target sections are separate and independent of one another. Therefore, damage to one module has no effect on the signal emitted by remaining modules of the target. Furthermore, because of redundant circuitry, a hit incapacitating one portion of a module will not incapacitate the entire module. Of course, destroyed modules can be readily replaced without affecting the operable modules.

Each target module can be separately controlled, if desired, to increase training realism with hot or cold surfaces. For example, energizing appropriate modules makes in possible to depict hot or cold road wheels or vehicle tracks.

This invention enables the accurate simulation of the total thermal signature of a particular vehicle or piece of equipment, even if the same target is viewed by thermal imaging devices operating in distinctly different areas of the electromagnetic spectrum. For example, some devices operate in the 3–5 Mm wavelength range and others in the 8–12 Mm wavelength range. Personnel being trained in the use of such thermal imaging devices should see different thermal signature cue intensities in the same target, as they would if viewing the real piece of equipment. The modules can be controlled to achieve this result.

Each target module can be quickly repaired on site using simple tools and inexpensive materials. This makes it possible to extend the life of the targets.

The thermal and electrical characteristics of each module are dependent upon its construction features. The characteristics of the infrared signal emitted by a module are determined by the thermal and electrical characteristics of the module. In one embodiment of this invention, the target is comprised of modules emitting different infrared signals. The signals can be varied by varying the resistivity of the electrically conductive layer, such as by employing conductive layers having different compositions or conductive layers having the same composition but different thicknesses in the modules comprising the target.

Several possible variations can be seen in FIGS. 6 and 7. The view of FIG. 6 is similar to the view of FIG. 3. Insulating layers 115 and 119 are provided similar to layers 15 and 19, but the electrically conductive layer 116 of this embodiment is not thoroughly uniform. Layer 116 has an area 170 having certain characteristics and additional areas 172, 174 and 176 that have characteristics that differ from those of area 170 and from those of one another.

The area 172 is made of the same composition as the area 170, but is a thicker layer, as can be seen in FIG. 7. This provides an increased path for current flow between the busbars 117 and 118, resulting in a decrease in the effective electrical resistance. The decrease in resistance increases the electrical power dissipation in area 172, thereby increasing the intensity of the thermal cue generated by that area.

The conductive material in area 176 is the same composition and thickness as in area 172. However, a number of perforations 175 in the conductive layer in area 176 decrease the area available to generate the thermal signal. Although the perforations also obstruct the electrical path between the busbars 117 and 118, the current density in the remaining portions of the conductive layer 176 is unchanged so that the reduction in infrared signal strength is proportional to the area of the perforations. The perforations are preferably circular, but may be any suitable shape. The size of the perforations should be less than will be individually resolvable through an infrared imager, but production efficiency is increased if the size is large enough so that a sufficient amount of layer 176 can be removed without an undue amount of labor. The perforations 175 may be formed by punching through the conductive layer 176 for those regions of the module in which a reduced intensity is desired. The exposed portions of the conductive layer surrounding the perforation are sealed by the layers 115 and 119.

The thermal cue can also be modified by using a composition having a different resistivity as the conductive layer. Thus, as shown in FIG. 7, the composition in area 174 has the same thickness as that of area 170, but by virtue of its different resistivity will allow a different amount of current to pass between busbars 117 and 118. Increasing the resistivity decreases the current and the radiated thermal cue intensity, and decreasing the resistivity increases the current and radiated thermal cue intensity.

The area can be selected, sized and located as desired to generate a thermal cue simulative of a portion of a military asset. The various areas 170, 172, 174 and 176 have been shown as different areas of one module 110 in FIGS. 6 and 7. However, it is equally within the scope of this invention for the conductive layers of a given module to be thoroughly uniform and for separate modules to have conductive layers that vary, like areas 170, 172, 174 and 176.

It will be understood that variations in conductive layer composition, thickness and integrity can be used in combination with one another as desired to achieve a particular thermal cue characteristic.

The intensity of the thermal signature can also be varied by raising and lowering the input electrical voltage to the various modules. This has the effect of varying the wattage per square foot, in accordance with Ohm's Law. Solid state or rheostat type variable voltage controls in the power supply may used to vary the voltage. The power supply may be a 12 or 24 volt battery pack, a portable generator, or auxiliary power from a vehicle. The ability to vary the thermal signature intensity of the target is also useful to accommodate instances of adverse weather. Multiple controls to independently vary each module may be used to simulate the equipment in a wide variety of operating modes.

Figure 8:
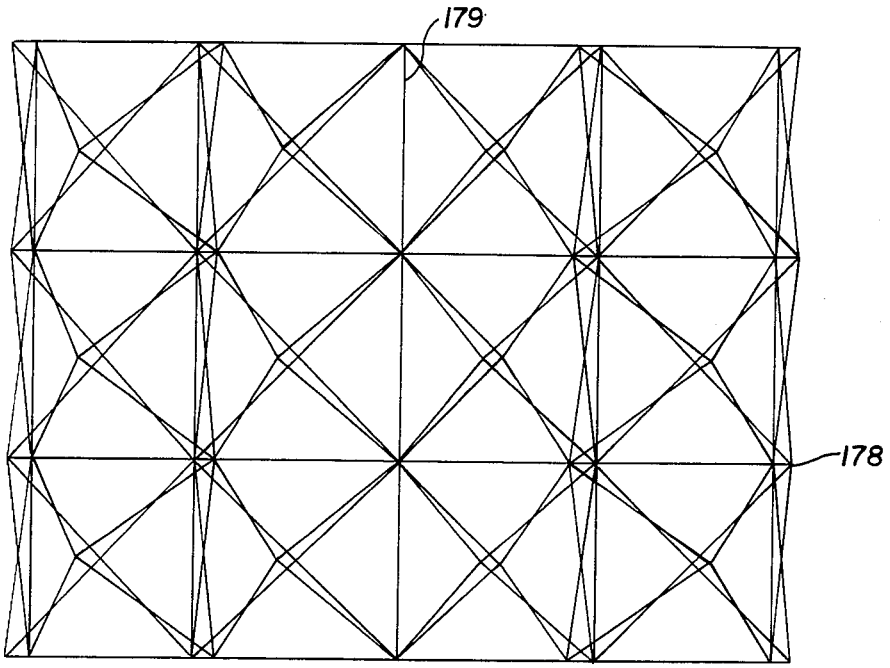
FIG. 8 is an elevation view of a preferred support frame.
Figure 9:
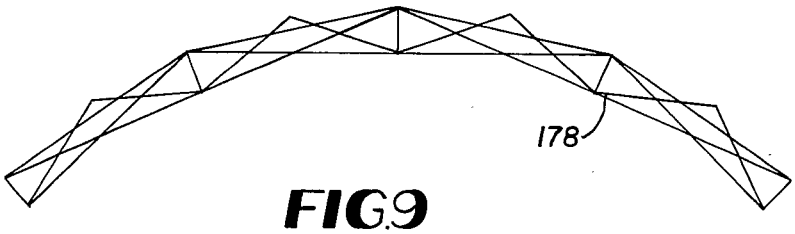
FIG. 9 is a top view of the support shown in FIG. 8.

As mentioned above, the modules are deployed on a support on a gunnery range. A preferred support 178, depicted in FIGS. 8 and 9, is lightweight and portable. It can be transported in a compact configuration and is quickly and easily set up in the field. This preferred support is the Instand 134C, sold by Nomadic Structures, Inc., 205 South Columbus Street, Alexandria, Va. 22314. Similar supports are described in U.S. Pat. Nos. 3,908,808; 4,026,313 and 4,290,244, all to Ziegler. The disclosures of these patents are incorporated herein by reference. Support 178 of FIG. 8 provides a planar surface on which to mount the target and stands about 8 feet high and 10 feet wide. The base of the support can be provided with eyebolts to allow it to be staked to the ground, and the support can be reinforced with guy wires or braces. Preferably a substrate 180 is mounted on the support 178 and the modules are affixed to the substrate. Variations in the modules as arranged on the substrate define the unique thermal signature of a target. As seen in FIG. 9, the support can be assembled to provide a curved profile so that the substrate and modules thereon are displayed to more than one direction, providing a signature presentation to viewers at various angles.

Figure 10:
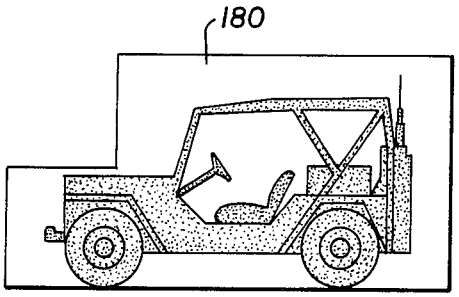
FIG. 10 is an elevation view of a further embodiment of the invention.

As shown in FIG. 10, the substrate 180 to which the modules are mounted may have printed, painted or otherwise displayed on a front side thereof the visual signature of the equipment being simulated. The visual signature appears on the one side of the substrate and the modules are fastened to the reverse side. In this manner the 'face' of the target is the visual signature, which overlays the corresponding thermal signature. The thermal signature is conducted through the substrate in the desired pattern and radiated by the surface of the substrate to any viewers using thermal imaging devices. This affords an additional opportunity to vary the apparent intensity of the target's thermal signature since the surface of the over laying substrate may be painted, treated or otherwise controlled to have varying emissivities. Such varied surface emissivities can vary the emitted cue intensity in accordance with the relationship expressed in the Stefan-Boltzman Equation.

The visual signature may be spray painted upon a flexible natural or synthetic cloth substrate 180, although other methods for imparting the visual signature to the substrate—such as silk screening, stencilling, hand painting, etc.—could be employed. Visual signature fidelity is of importance in a multi-spectral target or simulant due to the increased sophistication of modern electro-optical (EO) devices.

Preferably, the outer boundaries of the visual signature set the outer boundaries of the substrate since excess material beyond the signature of the equipment being simulated detected by an EO or thermal imaging device or both would show up as an artificial 'halo' around the target, detracting from its realism and effect. The cue of the visible signature must be consistent in size, shape and location with the cues of the infrared signature, i.e., the visible and infrared signature must be in correspondence with one another. The modules are mounted on the rear side of the substrate by any convenient means such as adhesive, sewing, stapling or insertion into pockets on the substrate.

Figure 11:
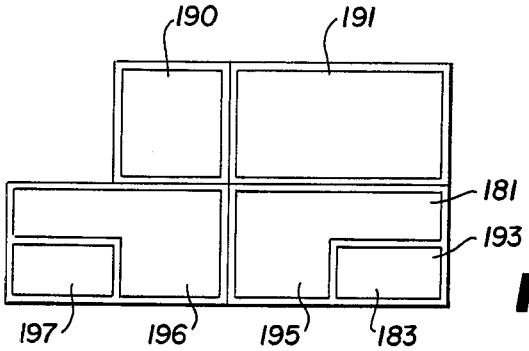
FIG. 11 is a schematic view of the embodiment of FIG. 10 showing the thermal cues emitted thereby.

The visible and thermal signatures of a target simulating an M-151 Jeep vehicle can be seen in FIGS. 10 and 11. The visible image on substrate 180 is depicted in FIG. 10 and the thermal cues emitted when an electrical current passes through the modules affixed to substrate 180 are depicted in FIG. 11. The modules emit infrared radiation which can be detected by a viewer with a thermal sight as cues 190, 191, 193, 195, 196 and 197. Cues 190 and 191 correspond to the upper body frame of the vehicle which is relatively cool and, therefore, emit low-intensity infrared radiation. Likewise, the cue 195 corresponds to a relatively cool portion of the Jeep, so it has a low intensity. The cues 193 and 197 correspond to the tires, the hottest part of the vehicle, and, therefore, have the most intense signal. Cue 196 corresponds to the engine and transmission which are hotter than the upper body, but not as hot as the tires, so cue 196 has a radiation intensity between that of cue 197 and that of cue 195. The cumulative effect of the individual cues 190–197 is to simulate the thermal signature of the flank of an M-151 Jeep.

The thermal cue 195 is generated by module 181 shown in FIG. 12. Each of busbars 200 and 202 are connected to one pole of the electrical power source and busbar 204 to the other pole of the source. As mentioned above, cue 195 has a lower intensity than the cue 193. This may be achieved by providing a thinner conductive layer in module 181 than in module 193, by making more perforations in the conductive layer of module 181 than in module 183, by making the composition of the conductive layer more resistive in module 181 than in module 183, by connecting a lower voltage source to module 181 than module 183, or by some combination of such techniques. The effective electrical resistance of the electrically conductive layer of module 183 is therefore less than that of the electrically conductive layer of module 181.

In addition, the target may be made to provide a radar signature as well. A radar corner reflector mounted on the support 178 may be oriented at an angle to simulate the radar signature of an asset by reflecting radar signals as the asset being simulated would reflect them. The radar signature must correspond with the visible and infrared signatures. That is, a viewer receiving infrared or visible cues should receive radar cues indicative of the same asset identifiable with the visible or infrared cues. Likewise, the visible and infrared cues must correspond with each other. A suitable radar corner reflector is disclosed in U.S. Pat. No. 2,452,822 to Wolf, the disclosure of which is incorporated herein by reference. Other designs would also be suitable.

It will be understood that a combined visible and infrared target has been described which is easily transported to and set up in the field and which accurately simulates visible, infrared and radar cues. The target is inexpensive, durable and convenient and can be made to simulate any suitable military asset.

What is claimed is:

1. A military target module capable of emitting infrared signals when an electric current from an electrical power source having two poles is passed therethrough comprising a unitary, composite laminate including:

(A) electrically insulating top and bottom layers, each layer having inner and outer surfaces;

(B) an electrically conductive layer between said inner surfaces, wherein said electrically conductive layer includes at least two areas having differing effective electrical resistances;

(C) at least two substantially parallel metallic busbars in contact with said electrically conductive layer, each of said busbars having two ends;

(D) a first electrical connector means for connecting both ends of one of said busbars to one pole of an electrical power source; and (E) a second electrical connector means for connecting both ends of another of said busbars to the other pole of the electrical power source, wherein said top layer and said bottom layer have edges which are sealed together to thereby form an enclosed laminate containing the electrically conductive layer.

2. A module as claimed in claim 1 wherein two areas of said electrically conductive layer have different effective resistances because the thickness of the conductive layer is different in said two areas.

3. A module as claimed in claim 1 wherein said two areas of said electrically conductive layer have different effective resistances because the conductive layer is comprised of different compositions in said two areas.

4. A module as claimed in claim 1 wherein said two areas of said electrically conductive layer have different effective resistances because said areas are perforated to different degrees.

5. A military target capable of emitting infrared signals simulative of the infrared signature of a military asset comprising a plurality of modules as claimed in claim 1 mounted adjacent one another on a support frame and an electrical power source having two poles respectively connected to said first and second electrical connectors, whereby infrared signals are generated by said modúles and together simulate said infrared signature.

6. A target as claimed in claim 5 wherein said modules are not all congruent.

7. A target as claimed in claim 5 wherein said support frame is arcuate, thereby displaying said modules thereon to more than one direction.

8. A target simulating a military asset comprising (A) a support frame;

(B) an electrical power source having two poles;

(C) a substrate having front and rear sides, supported by said support frame, said front side having a visual representation of the military asset thereon; and (D) a plurality of modules each of which is capable of emitting infrared signals when an electric current is passed therethrough and is supported adjacent another on said rear side of said substrate in correspondence with said visual representation.

9. An electically operable military target simulating a military asset comprising (A) a support frame;

(B) an electrical power source having two poles;

(C) a substrate having front and rear sides supported by said support frame, said front side having a visual representation of the military asset thereon; and (D) a plurality of modules, each of which is capable of emitting infrared signals when an electric current is passed therethrough and is mounted adjacent another on said rear side of said substrate in correspondence with said visual representation and each comprising a unitary composite laminate including:

(1) electrically insulating top and bottom layers, each layer having edges and inner and outer surfaces;

(2) an electrically conductive layer between said inner surfaces;

(3) at least two substantially parallel busbars in contact with said electrically conductive layer;

(4) a first electrical connector means for connecting one of said busbars to one pole of said electrical power source;

(5) a second electrical connector means for connecting another of said busbars to the other pole of said electrical power source;

(E) wherein said edges of said top and bottom layers are sealed together to thereby form an enclosed laminate containing said electrically conductive layer; and (F) wherein the effective electrical resistance of the electrically conductive layers of two of said plurality of modules differ from one another.

10. An electrically operable military target as claimed in claim 9 wherein the electrically conductive layer of one of said modules has perforations therein.

11. An electrically operable military target as claimed in claim 9 wherein the electrically conductive layer of one of said modules is thicker than the electrically conductive layer of another of said modules.

12. An electrically operable military target as claimed in claim 9 wherein the electrically conductive layer of one of said modules is of a different composition than the electrically conductive layer of another of said modules.

13. An electrically operable military target as claimed in claim 9 wherein a radar corner reflector is mounted on said support frame at an orientation to reflect radar signals as the military asset being simulated would reflect radar signals.

* * * * *